US011047096B2

(12) United States Patent
Winkels

(10) Patent No.: US 11,047,096 B2
(45) Date of Patent: Jun. 29, 2021

(54) ROAD MILLING MACHINE AND METHOD FOR CONTROLLING A ROAD MILLING MACHINE

(71) Applicant: Wirtgen GmbH, Windhagen (DE)

(72) Inventor: Sebastian Winkels, Windeck (DE)

(73) Assignee: Wirtgen GmbH

( * ) Notice: Subject to any disclaimer, the term of this patent is extended or adjusted under 35 U.S.C. 154(b) by 84 days.

(21) Appl. No.: 16/668,302

(22) Filed: Oct. 30, 2019

(65) Prior Publication Data

US 2020/0131722 A1 Apr. 30, 2020

(30) Foreign Application Priority Data

Oct. 31, 2018 (DE) ..... 10 2018 127 222.7

(51) Int. Cl.
*E01C 23/00* (2006.01)
*E01C 23/088* (2006.01)

(52) U.S. Cl.
CPC ..... *E01C 23/088* (2013.01)

(58) Field of Classification Search
CPC ..... E01C 23/088
USPC ..... 404/72, 75, 84.01–84.8
See application file for complete search history.

(56) References Cited

U.S. PATENT DOCUMENTS 5,722,789 A * 3/1998 Murray ..... B28D 1/18 299/39.4
6,287,048 B1 * 9/2001 Hollon ..... E01C 19/006 404/104
6,682,261 B1 * 1/2004 Karamihas ..... E01C 23/07 299/1.5
8,690,474 B2 4/2014 Jurasz et al.
9,057,161 B2 6/2015 Berning et al.
9,879,391 B2 1/2018 Berning et al.
2002/0047301 A1 4/2002 Davis
2003/0175077 A1 * 9/2003 Godbersen ..... E01C 23/07 404/84.2
2014/0270952 A1 * 9/2014 Karsten ..... E01C 23/088 404/75
2020/0263366 A1 * 8/2020 Schlenker ..... B60G 3/01
2020/0308783 A1 * 10/2020 Muir ..... E01C 23/088

FOREIGN PATENT DOCUMENTS

DE 102006020293 A1 11/2007
DE 102006062129 A1 7/2008
EP 547378 A1 6/1993
EP 1154075 A2 11/2001
EP 2392731 A2 12/2011

* cited by examiner

*Primary Examiner* — Raymond W Addie
(74) *Attorney, Agent, or Firm* — Lucian Wayne Beavers; Gary L. Montle; Patterson Intellectual Property Law, PC

(57) ABSTRACT

A self-propelled road milling machine includes a plurality of height sensors and a controller configured to determine a cross slope of the roadway being milled. Wherein in a first leveling mode at least two sensors are longitudinally aligned and laterally spaced on one side of the milling machine, closet to the center of the road. The controller using sensor signals to adjust the cross slope of the milling drum to be parallel to the cross slope of the roadway adjacent the milling machine. Wherein in a second leveling mode the sensors are on opposite sides of the milling drum.

22 Claims, 5 Drawing Sheets

ROAD MILLING MACHINE AND METHOD FOR CONTROLLING A ROAD MILLING MACHINE

CROSS-REFERENCES TO RELATED APPLICATIONS

This application claims benefit of German Patent Application No. 10 2018 127 222.7, filed Oct. 31, 2018, and which is hereby incorporated by reference.

FIELD OF THE DISCLOSURE

The invention relates to a road milling machine having a machine frame on which a milling drum is arranged. Moreover, the invention relates to a method for controlling a road milling machine.

BACKGROUND

In road construction, self-propelled construction machines of different types are used. These machines include the well-known road milling machines, with which existing road layers of the road superstructure can be removed. The known road milling machines have a rotating milling drum which is equipped with milling tools for machining the road surface. The milling drum is arranged on the machine frame, which is adjustable in height relative to the traffic surface to be machined. The height of the machine frame is adjusted by means of lifting devices which are functionally assigned to the individual crawler tracks or wheels (running gear). For milling a defective road surface, the machine frame is lowered, such that the milling drum penetrates into the road surface. These lifting devices allow both the height adjustment of the machine frame and/or the milling drum and the setting of a prespecified inclination of the machine frame and/or the milling drum in a direction transverse to the advancing direction of the road milling machine.

For precise adjustment of the milling depth and inclination, the known road milling machines have a levelling device which has one or more distance measuring devices for measuring the distance between a reference point with respect to the machine frame and the traffic surface. The distance measuring devices have one or more distance sensors. Distance measuring devices with a plurality of distance sensors (multiplex) arranged at an offset in the longitudinal direction of the machine frame are used to take long-wave irregularities into account. In these multiplex systems, the distance sensors may be mounted on an elongated boom which is attached to one side of the machine frame.

DE 10 2006 020 293 A1 discloses a levelling device for a road milling machine which furnishes a sensor on both the left side and the ride side of the road milling machine for detecting the actual value of the milling depth, and a sensor for detecting the current lateral inclination of the milling drum with respect to the horizontal. According to the deviation of the measured actual values from the target values, the milling depth on the left and right side of the machine can be adjusted. The milling depth can be adjusted on each of the two sides according to the actual values of the milling depth on the given side. However, the milling depth can also only be adjusted on one of the two sides according to the given actual values of the milling depth. In this case, the milling depth on the opposite side can be adjusted via the lateral inclination.

EP 0 547 378 B1 describes a levelling device for a road milling machine which has three ultrasonic sensors which are arranged one behind the other in the advancing direction of the milling machine. The traffic surface is scanned as a reference surface using the ultrasonic sensors. The distance sensors are arranged on the machine frame at the height of the running gear, and one sensor is arranged between the running gear. The distance values are evaluated statistically—for example, an average is calculated—to generate a control signal for the lifting devices for the height adjustment of the running gear. Levelling devices are also known from DE 10 2006 062 129 A1, EP 2 392 731 A2 or EP 1 154 075 A2.

The roads to be machined can have different profiles. On a straight stretch of road, a road may have a crowned profile. In a right-hand turn, the road surface may be inclined to the right in the direction of travel with respect to the horizontal—and to the left in a left-hand turn.

BRIEF SUMMARY

The invention relates to a milling process, also referred to as copy milling, in which a covering of the same thickness (milling depth) is to be milled at each point of the road, in which case the inclination of the milled surface of the road (traffic surface) with respect to the horizontal should not be changed. If, for example, for a road with a crowned profile, the road surface of the right-hand lane should be milled, and the road milling machine should drive on the right (right-hand traffic). The milling drum must penetrate into the road surface to a prespecified milling depth, and the milling drum or the machine frame on which the milling drum is mounted must be inclined relative to the horizontal by a prespecified angle to the right. If the road to be milled and/or the driving surface has a greater width than the milling drum, the driving surface and/or road must be milled in several sections (tracks). For example, a track section on the outside of the driving surface (first milling track) is machined and then a track section on the inside of the driving surface (second milling track) is machined.

At the beginning of the milling work, the road milling machine is positioned on the driving surface. Next, the lifting devices assigned to the running gear are retracted so that the machine frame lowers together with the milling drum. The machine frame is lowered until the milling tools of the rotating milling drum just touch the road surface. This process is referred to as "scratching". In this case, the milling drum should be aligned parallel to the road surface, thereby determining the orientation of the machine frame.

If a track section on the outside of the driving surface is to be milled, the milling depth can be measured on the left side (in the working direction) of the milling drum. For this purpose, the distance of a reference point which is located on the left side of the milling drum is measured to the unmilled traffic surface relative to the machine frame of the road milling machine. However, no suitable reference surface is present on the right side of the construction machine in the working direction. Therefore, a distance measurement on the right-hand outside driving surface edge cannot be readily made. Although a guide wire could be laid for a distance measurement on the right side, this proves to be relatively complicated in practice.

In the present case, the milling depth on the right side of the construction machine could also be adjusted by the inclination of the machine. An inclination of the construction machine to the left leads to an increase in the milling depth, and an inclination of the machine to the right leads to a reduction in the milling depth on the right side. In order to be able to adjust the milling depth on the right-hand side by changing the inclination of the construction machine, however, the inclination to be set must be known over the entire course of the route. Therefore, additional information (data) about the slope of the road must be provided, which makes the control of the construction machine relatively complicated.

An object of the invention is to create a road milling machine which allows precise machining of a traffic surface, and particularly enables precise machining of a traffic surface without the provision of additional information about the inclination of the surface to be machined. In addition, it is an object of the invention to provide a method which enables exact machining of a traffic surface, in particular without the provision of additional information about the inclination of the surface to be machined.

These objects are achieved according to the invention by the features of the independent claims. The subject matter of the dependent claims relates to advantageous embodiments of the invention.

The inventive self-propelled road milling machine has a machine frame on which a milling drum is arranged, at least one running gear on the left in the working direction, and at least one running gear on the right in the working direction. In total, at least three running gear mechanisms are provided. Preferably, the road milling machine has front and rear running gear on the left side and front and rear running gear on the right side. Lifting devices which carry the machine frame are functionally assigned to the individual running gear mechanisms. The height and/or inclination of the machine frame and/or the milling drum with respect to the traffic surface (road surface) or the horizontal can be increased or decreased by means of the lifting devices.

In addition, the road milling machine has a levelling device for driving the lifting devices, which is designed in such a manner that the height and/or inclination of the machine frame is adjusted with respect to the traffic surface and/or the horizontal.

The levelling device has a first distance measuring device which is designed in such a manner that the distance between at least one reference point and the traffic surface is measured, a first distance value thus being determined, and a second distance measuring device, which is designed in such a manner that the distance between at least one reference point and the traffic surface is measured, a second distance value thus being determined. In this context, a reference point is understood to be a reference that defines a specific height. A line or plane on which the reference point lies can also be taken as a reference. If several distance measurements are carried out for each reference point, a distance value which is available for further evaluation can be determined from the measured values. For example, the average value of the measured values can be calculated.

The levelling device has a control and computation unit that is configured in such a manner that the distance value determined by the first and/or second distance measuring devices is compared in each case to a prespecified distance value, and control signals are generated for the lifting devices according to the deviation of the determined distance value from the prespecified distance value. In this context, 'control signals' are understood to mean the signals or data required for controlling the lifting devices and/or their associated assemblies, such as hydraulic units. The lifting devices cause the lifting and lowering and/or the alignment of the machine frame according to the control signals.

The control and computing unit of the levelling device can form an independent module, or at least a portion of it can be part of the central control and computing unit of the construction machine. The control and computing unit 12 can have, for example, a general processor, a digital signal processor (DSP) for continuously processing digital signals, a microprocessor, an application-specific integrated circuit (ASIC), an integrated circuit consisting of logic elements (FPGA), or other integrated circuits (IC) or hardware components in order to carry out the control of the lifting devices. A data processing program (software) can run on the hardware components. A combination of the various components is also possible.

The levelling device provides a special control mode which is intended for the operation of the road milling machine in the event that a track section on the outside of the driving surface will be machined. This control mode is referred to as a levelling mode for a track section on the outside of the driving surface. The levelling device may provide other control modes intended for other operating situations. The first and/or second distance measuring devices are designed for the levelling mode for a track section on the outside of the road and designed in such a manner that their reference points lie only on the same side of the milling drum in the working direction, in which case the reference point of the second distance measuring device lies on the side of the reference point of the first measuring device facing away from the milling drum at a prespecified lateral distance from the reference point of the first distance measuring device. The first measurement can take place close alongside to the milling drum.

The control and computing unit is configured in such a manner that, according to the deviation of the first distance value determined by the first distance measuring device from the prespecified distance value, the control and computing unit generates control signals for the lifting device which is functionally assigned to the running gear and which faces toward the reference point of the first distance measuring device, and, according to the deviation of the second distance value determined by the second distance measuring device from the prespecified distance value, generates control signals for the lifting device which is functionally assigned to the running gear facing away from the reference point of the first distance measuring device.

If two running gear mechanisms are provided on the left or right sides, control signals can be generated for the lifting device which is functionally assigned to the front and/or rear running gear mechanisms.

The side on which both of the two reference points lie depends on whether the road milling machine moves in the working direction on the right side (right-hand traffic) or on the left side (left-hand traffic).

A particularly preferred embodiment of the road milling machine is particularly suitable for right-hand traffic. This embodiment is referred to below.

The first and/or second distance measuring devices for the levelling mode for a track section on the outside driving surface are designed for right-hand traffic, and designed in such a manner that their reference points lie on the left side of the milling drum in the working direction, in which case the reference point of the second distance measuring device lies on the left side of the reference point of the first distance measuring device at a prespecified lateral distance from the reference point of the first distance measuring device. The first measurement can take place on the left side of the machine close alongside the milling drum.

The control and computing unit intended for right-hand traffic is configured in such a manner that the control and computing unit generates control signals for the lifting device functionally assigned to the left-hand running gear in the working direction according to the deviation of the first distance value determined by the first distance measuring device from the prespecified distance value, and, according to the deviation of the second distance value determined by the second distance measuring device from the prespecified distance value, generates control signals for the lifting device which is functionally assigned to the right-hand running gear in the working direction.

For the machining of a track section on the inner side of the road, the first distance measuring device is designed in such a manner that its reference point is on the left side of the milling drum in the working direction, and the second distance measuring device is designed in such a manner that its reference point is on the right side of the milling drum in the working direction. The reference point of the second distance measuring device therefore lies at a prespecified lateral distance from the reference point of the first distance measuring device on the right side of the reference point of the first distance measuring device. The two measurements can each take place close alongside the milling drum. This levelling mode is part of the prior art.

To raise and lower the machine frame and/or to adjust the inclination of the machine frame, the control and computing unit can be configured in such a manner that the lifting devices are retracted or extended. Consequently, the deviation of the first and/or second distance values determined by the first and/or second distance measuring devices, respectively, from the prespecified distance value can be minimized.

For the levelling mode in a track section on the outside driving surface, the control and computation unit may be configured to retract the lift device which is functionally assigned to the running gear on the left in the working direction when the first distance value determined by the first distance measuring device is greater than the prespecified distance value, and to extend the lifting device which is functionally assigned to the running gear on the left in the working direction when the first distance value determined by the first distance measuring device is less than the prespecified distance value, and to extend the lifting device which is functionally assigned to the running gear on the right in the working direction when the second distance value determined by the second distance measuring device is greater than the prespecified distance value, and to retract the lifting device which is functionally assigned to running gear on the right in the working direction when the second distance value determined by the second distance measuring device is less than the prespecified distance value. For the levelling mode in a track section on the inside driving surface, the control and computation unit may be configured to retract the lift device which is functionally assigned to the running gear on the left in the working direction when the first distance value determined by the first distance measuring device is greater than the prespecified distance value, and to extend the lifting device which is functionally assigned to the running gear on the left in the working direction when the first distance value determined by the first distance measuring device is less than the prespecified distance value, and to retract the lifting device which is functionally assigned to the running gear on the right in the working direction when the second distance value determined by the second distance measuring device is greater than the prespecified distance value, and to extend the lifting device which is functionally assigned to running gear on the right in the working direction when the second distance value determined by the second distance measuring device is less than the prespecified distance value.

In a road milling machine which is intended for left-hand traffic, the opposite configuration is used in an analogous manner.

For each of the two levelling modes, only two laterally offset distance measurements are required. In principle, only two distance measuring devices are therefore required. The distance measuring devices may have interchangeable scanning sensors on the road milling machine, which can be attached to suitable brackets. If interchangeable distance sensors are provided, the road milling machine can be converted for one levelling mode or the other levelling modes by one of the two distance sensors being installed on the same side as the other distance sensor, or on the other side. The road milling machine can also be equipped with three permanently installed distance sensors, in which case only two distance sensors are active at any one time, and the distance sensors are used in alternation according to the levelling mode.

In principle, the control and computing unit of the levelling device can make use of the same calculation algorithms for the two levelling modes. In addition, the same hardware components and assemblies can be used for implementing the control functions. The difference in the evaluation of the measured values is substantially that, when the measurement is shifted from one side of the road milling machine to the other side—for example, from the right side to the left side, and in particular into the region of the centre of the road—the opposite movement the associated lifting device must be performed. By way of example, when the second distance value determined by the second distance measuring device is greater than the prespecified distance value, the lifting device which is functionally assigned to the running gear on the right side is not retracted, but rather extended.

In a preferred embodiment, the lateral distance of the reference point of the second distance measuring device to the reference point of the first distance measuring device in the levelling mode for a track section on the outside driving road substantially corresponds to the lateral distance of the reference point of the second distance measuring device to the reference point of the first distance measuring device in the levelling mode for a track section on the inside driving surface.

The lateral distance from the reference point of the second distance measuring device to the reference point of the first distance measuring device can largely correspond to the width of the machine frame of the road milling machine, or the distance between the running gear (track width), or the width of the milling drum. The lateral distance can also be greater or smaller. Choosing the same distance for both operating modes has the advantage that, for the same control deviation in both operating modes, the distance of the movement of the lifting devices is the same—merely in opposite directions. Consequently, for the different configurations of the control and computing unit for both levelling modes, it is only necessary to take into account a "sign reversal" in the evaluation of the measured values, such that, for the implementation of the system on the road milling machines according to the prior art, only a relatively small amount of programming is required.

If the lateral distance of the reference point of the second distance measuring device to the reference point of the first distance measuring device in both operating modes is different—for example, if the conditions on the site make this necessary—then, in addition to the "sign reversal", a conversion factor which is the ratio between the distance in one mode and the distance in the other mode must be taken into account as well. For example, the actuating signals for the piston/cylinder devices of the lifting devices can be calculated using a factor. If, in the operating mode according to the invention in which both distance sensors lie on one side of the machine frame, the distance corresponds to half the distance of the two distance sensors in the operating mode in which both distance sensors lie on different sides of the machine frame, a conversion factor of 2 is used for the operating mode according to the invention—which corresponds to the ratio of the distances.

The first and/or second distance measuring device can each have one or more distance sensors. For the levelling mode for the outside of the road, only one additional distance sensor needs to be provided—or an existing distance sensor needs to be installed on the other machine side.

The distance sensor may be, for example, any desired tactile or non-contact distance sensor. The edge protector included in known road milling machines on the end faces of the milling drum, contacting the ground, can also function as a sensing element of a tactile distance sensor. By way of example, optical or inductive or capacitive distance sensors, or ultrasonic distance sensors, can be used as non-contact distance sensors.

The distance measurement can be a point measurement. In practice, however, the known distance sensors provide the measurement in relation to a surface area—for example, a circular surface area in the case of an ultrasonic sensor, or the contact surface of an edge protector. So as to take uneven surface characteristics into account, the first and/or second distance measuring device may comprise a row of distance sensors arranged in the longitudinal direction of the road milling machine (multiplex), wherein the distance measuring device is designed in such a manner that the distance value is determined from the distances measured by the distance sensors. The distance value may be, for example, the average value of the measured distances.

BRIEF DESCRIPTION OF THE SEVERAL VIEWS OF THE DRAWINGS

An embodiment of the invention is explained in more detail below with reference to the drawings, in which.

DETAILED DESCRIPTION

Figure 1:
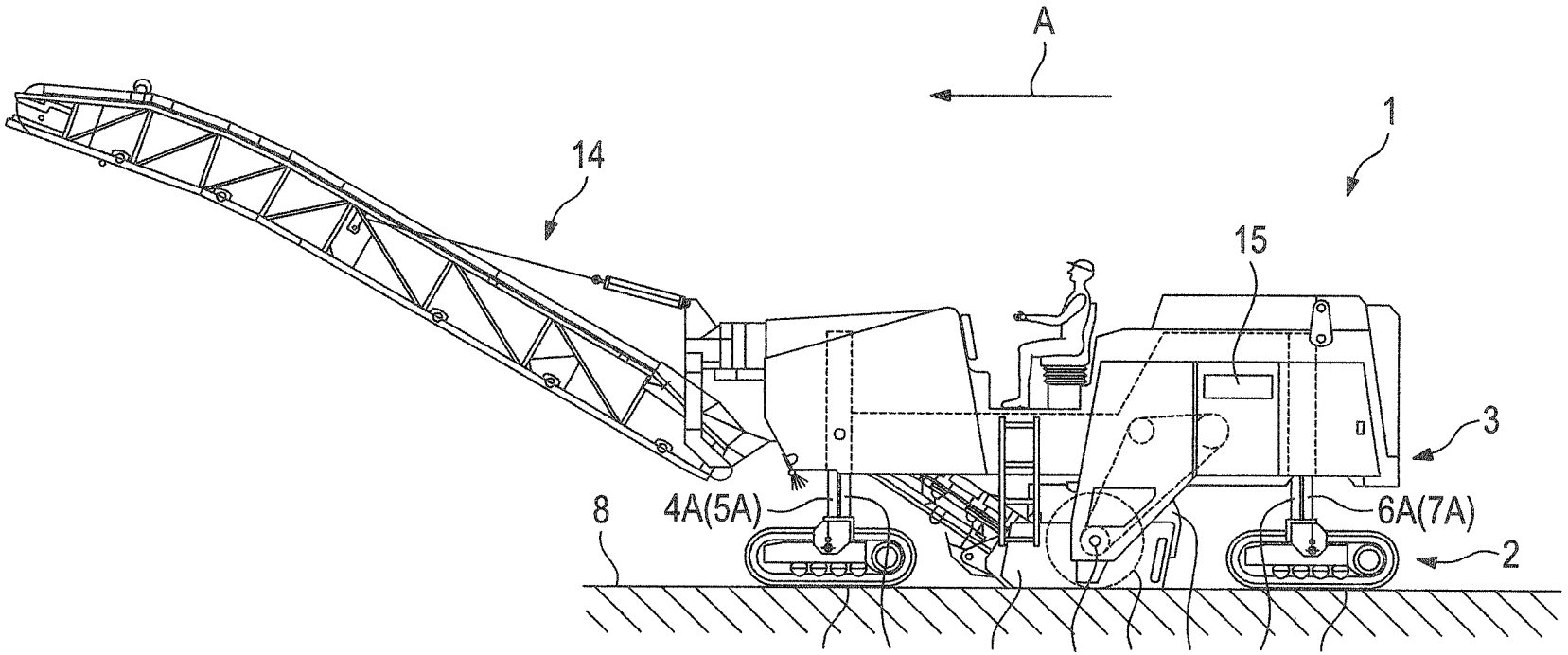
FIG. 1 shows a side view of an embodiment of a road milling machine.

FIG. 1 shows a side view of a self-propelled road milling machine 1 for milling road surfaces. The road milling machine 1 has a chassis 2 and a machine frame 3. The chassis 1 has, in the working direction A, a front left running gear 4 and a front right running gear 5, as well as a left rear running gear 6 and a right rear running gear 7. Chain tracks or wheels can be used as the running gear.

To adjust the height and/or inclination of the machine frame 3 relative to the surface of the ground (traffic surface), the road milling machine has lifting devices 4A, 5A, 6A, 7A on which the machine frame 3 is supported, and which are functionally assigned to the individual running gear mechanisms 4, 5, 6, 7. The lifting devices 4A, 5A, 6A, 7A each have a piston/cylinder arrangement 9.

The road milling machine 1 further has a milling drum 10 equipped with milling tools, which is arranged on the machine frame 3 between the front and rear running gear mechanisms 4, 5, 6, 7 in a milling drum housing 11, which is closed on the longitudinal sides by a left and a right edge protector 12, 13.

By retracting and extending the piston/cylinder assemblies 9 of the lifting devices 4A, 5A, 6A, 7A, the height and/or inclination of the machine frame 3, and the milling drum 10 arranged on the machine frame, can be adjusted relative to the traffic surface 8.

A conveyor device 14 with a conveyor belt is provided to carry away the milled surface pavement.

Figure 2:
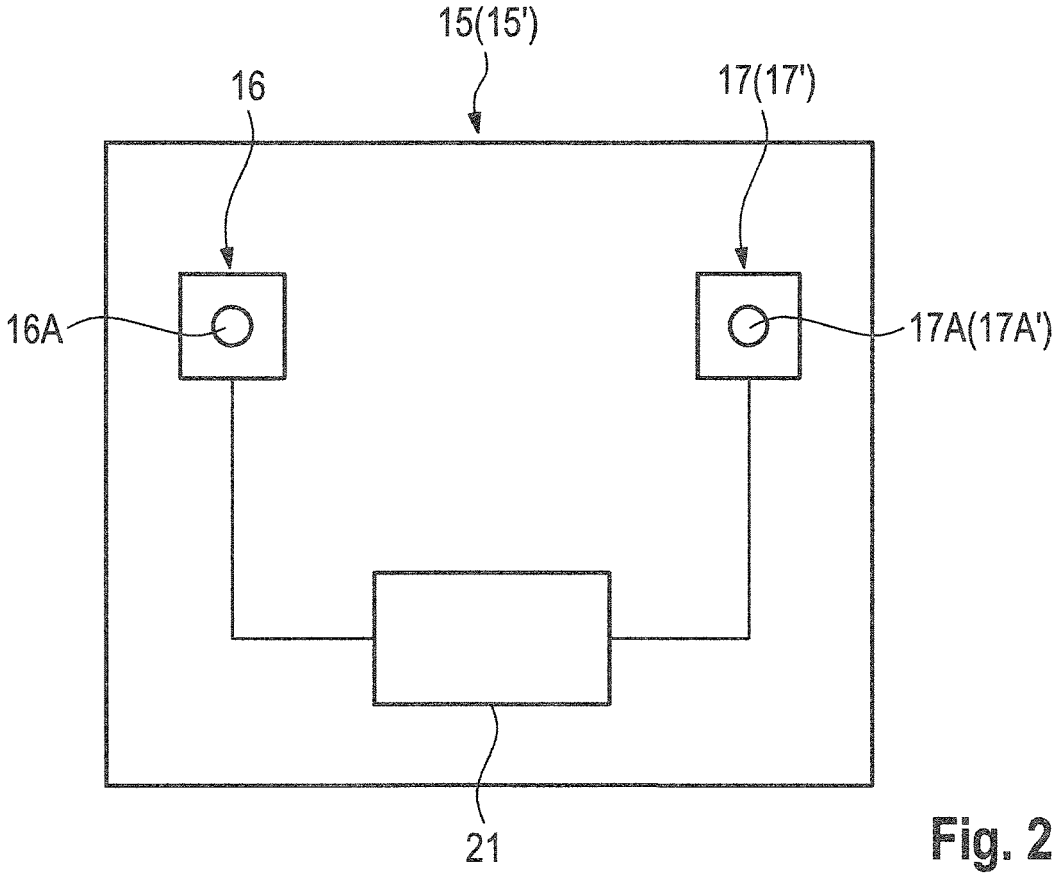
FIG. 2 shows the levelling device of the road milling machine in a highly simplified schematic representation.

The road milling machine according to the invention has a levelling device 15 (shown only schematically in FIG. 1) for driving the lifting devices 4A, 5A, 6A, 7A. FIG. 2 shows a highly simplified schematic representation of the levelling device. The levelling device 15 will be described below.

The levelling device 15 has a first distance measuring device 16 and a second distance measuring device 17, which in the present embodiment each have a distance sensor 16A, 17A. However, instead of distance measuring devices with only one sensor, distance measuring devices with a plurality of distance sensors arranged in a row—as known in the prior art—can also be used. As a result, further description of these distance measuring systems is not necessary here.

The levelling device 15 described below is intended for a road milling machine which is particularly suitable for right-hand traffic.

Figure 5:
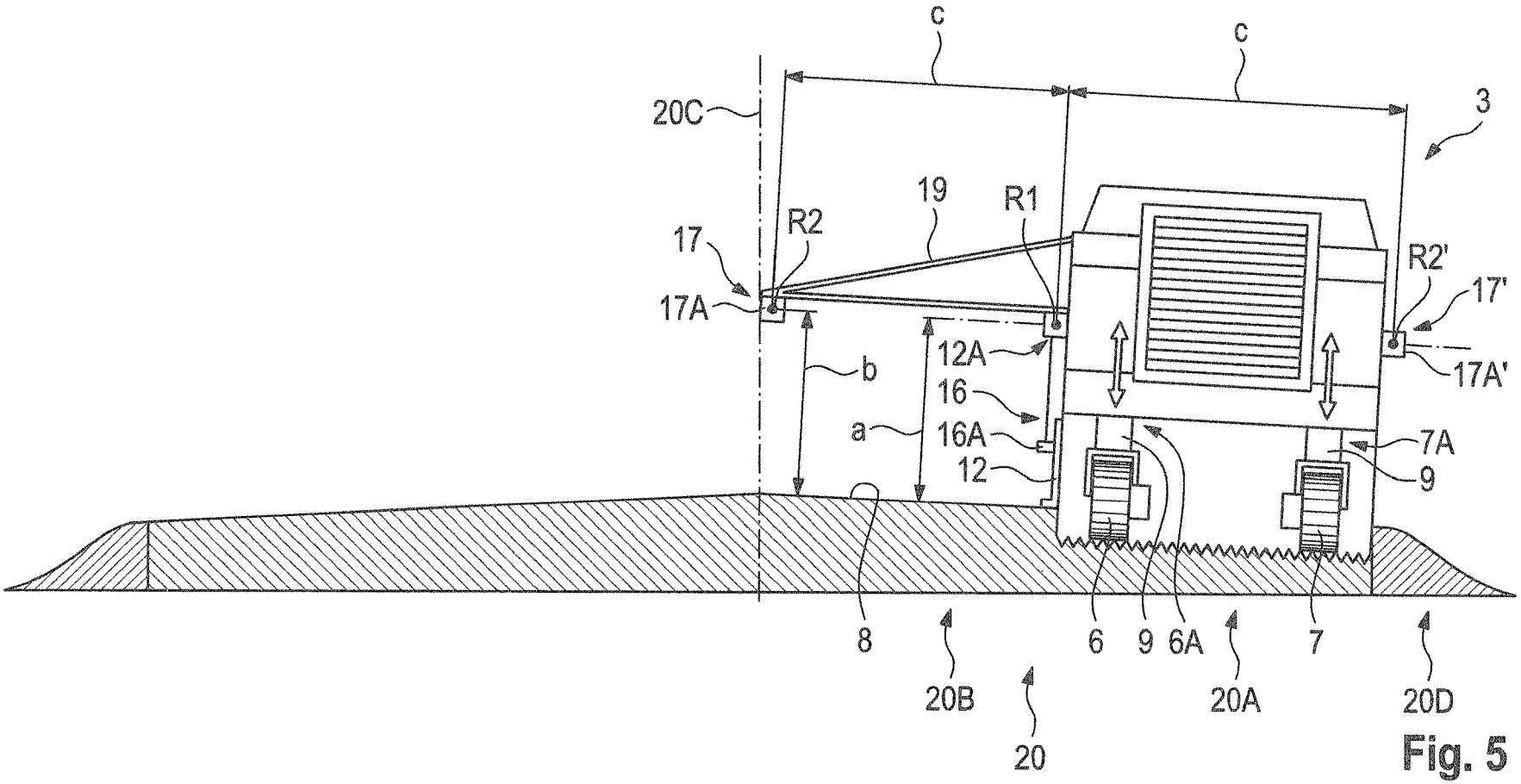
FIG. 5 shows a simplified schematic representation of the road milling machine machining the track section on the outside of the driving surface.

The first distance measuring device 16 has a distance sensor 16A which is arranged on the left side of the machine frame 3 in the working direction A between the front and rear running gear mechanisms 4, 5, 6, 7, preferably laterally adjacent to the milling drum 10 (FIG. 5). This distance sensor 16A is in the present embodiment a tactile distance sensor that makes use of the left edge protector 12, to which a draw-wire sensor 12A is attached. If the edge protector is attached via two height-adjustable hydraulic cylinders that are offset in the direction of travel, the height of the edge protector can also be detected by means of a displacement measuring system integrated into the hydraulic cylinders, rather than by means of a draw-wire sensor. The edge protector 12 rests on the traffic surface 8. The draw-wire sensor 12A measures the distance by which the edge protector 12 moves up and down. Consequently, the distance a can be measured between a first reference point R1, which is related to the road milling machine, and the traffic surface 8 on which the edge protector 12 rests.

In the present embodiment, the second distance measuring device 17 has an optical distance sensor 17A which is arranged on the left side of the machine frame 3 in the working direction between the front and rear running gear mechanisms 4, 5, 6, 7, preferably at the height of the milling drum 10. Preferably, the reference points R1 and R2 of the first and/or second distance sensors 16, 17 lie in a vertical plane which is intersected substantially orthogonally by the longitudinal axis of the machine frame, and in which the axis of the milling drum preferably also substantially lies. The reference point R2 of the second distance sensor 17A lies at a prespecified lateral distance c from the reference point R1 of the first distance sensor 16A, on the left side of the reference point R1 of the first distance sensor 16A in the working direction A. The second distance sensor 17A is attached to a holder 19—for example, to a laterally projecting rod—which in turn is attached to the machine frame 3.

The measurement on the inner side of the driving surface 20B is preferably carried out in the region of the driving surface centre 20C, particularly preferably on the driving surface centre 20C, since the driving surface 20 has the least damage at this position. Consequently, a measurement is not carried out on the shoulder 20D of the driving surface 20 (berm). In the present embodiment, the driving surface 20 is about twice as wide as the width of the milling drum 10 (milling track). The prespecified distance c between the two distance sensors 16A, 17A should therefore correspond to approximately half the driving surface width, or to the width of the road milling machine, or the width of the milling drum, or the spacing of the running gear (track width). Other distances can in an analogous manner result from the given lane width or the width of the milling track.

Moreover, the levelling device 15 has a control and computation unit 21 configured to perform the following steps.

In the levelling mode for a track section on the outside of the driving surface 20A, the control and computing unit 21 activates the first and/or second distance measuring devices 16, 17. The first distance sensor 16A measures the distance a, and the second distance sensor 17A measures the distance b. If a plurality of distances $a_1$, $a_2$, $a_3$ and $b_1$, $b_2$, $b_3$ is measured with a plurality of distance sensors, the control and computing unit 21 of the levelling device 15 calculates, by way of example, the average of the distances $a_1$, $a_2$, $a_3$ and $b_1$, $b_2$, $b_3$ as the distance value $a_{actual}$ or $b_{actual}$. From the distance values, the milling depth can be determined after an adjustment of the distance measuring device—which will be described in more detail below.

At the beginning of the milling work, the levelling device 15 is adjusted—and in particular the zero point is set. To set the zero point, the lifting devices 4, 5, 6, 7 are adjusted in such a manner that the milling drum 10 contacts the traffic surface 8 with the cylindrical surface inscribed by the tips of the milling tools. For this purpose, the lifting devices 4A, 5A, 6A, 7A are retracted until the milling tools of the rotating milling drum 10 begin to scratch the road surface. This process initiates first contact. When the milling bits contact the traffic surface 8, the distance measuring devices 16, 17 are set to zero. When the lifting devices 4A, 5A, 6A, 7A are further retracted and the milling drum 10 penetrates into the road surface, negative distance values are captured. The amount of the distance values corresponds to the milling depth. The determined distance values can be displayed as positive values—e.g., 5 cm milling depth.

The determined distance values $a_{actual}$ and $b_{actual}$ are each compared to prespecified distance values $a_{target}$ and $b_{target}$.

Figure 3:
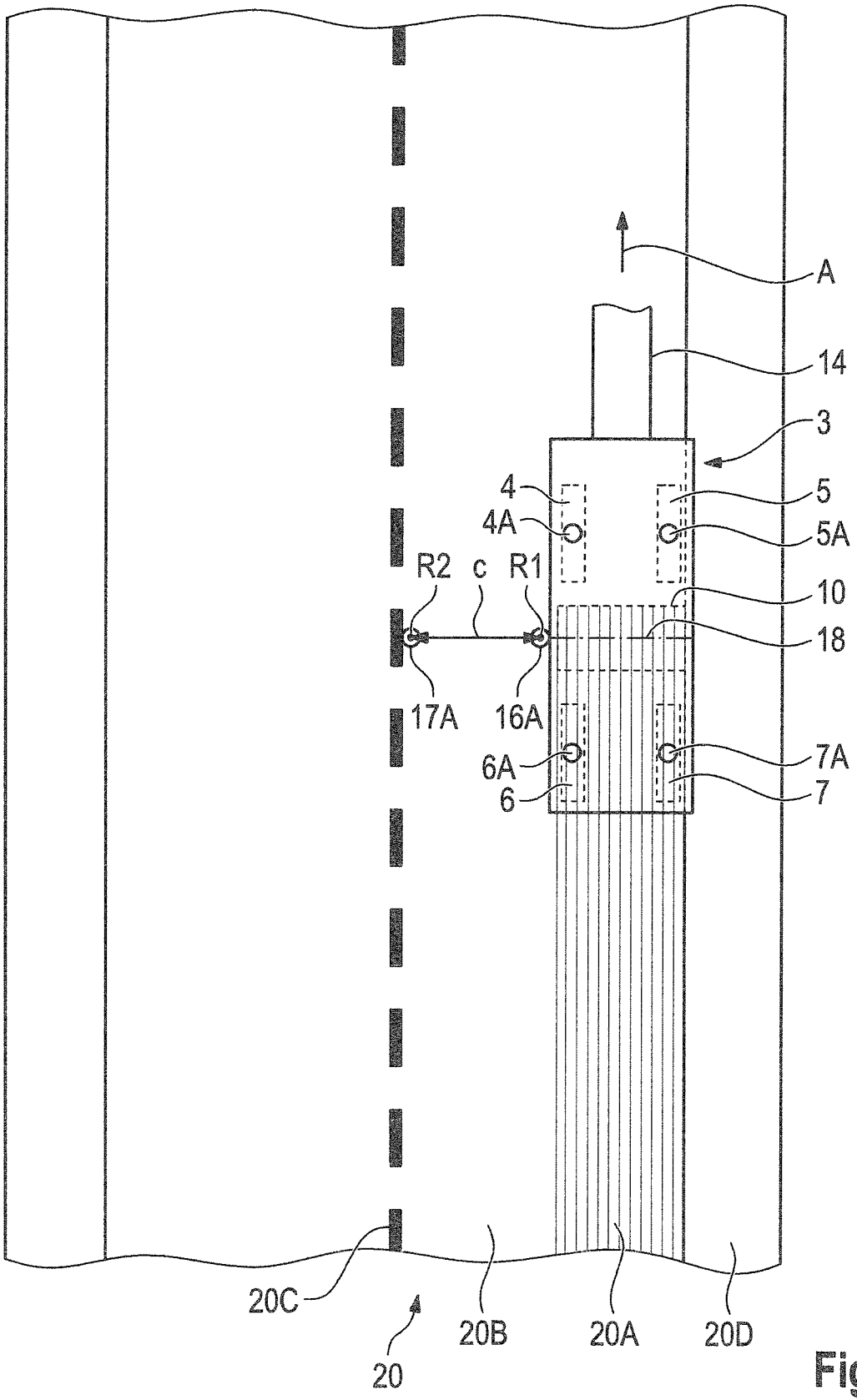
FIG. 3 shows a plan view of a driving surface that is being machined by the road milling machine, in which the road milling machine is machining a track section on the outside of the driving surface.

FIGS. 3 and 5 show the case in which the road milling machine 1 will machine the right track section on the outside of the driving surface 20A, wherein this track section is inclined toward the outside of the driving surface. During its alignment, the road milling machine 1 therefore assumes an inclination with respect to the horizontal. The set milling depth corresponds to the thickness of the cover to be removed from the road surface.

As the road milling machine 1 advances, the determined distance values $a_{actual}$ and $b_{actual}$, which correspond to the actual milling depth, are compared with the prespecified distance values $a_{target}$ and $b_{target}$ which correspond to the desired milling depth ($\Delta a = a_{actual} - a_{target}$ or $\Delta b = b_{actual} - b_{target}$). According to the deviation of the actual distance value from the target distance value of the first distance sensor 16A ($\Delta a = a_{actual} - a_{target}$), control signals are generated for the lifting device(s) 4A, 6A which is/are functionally assigned to the left—in the working direction—front and/or rear running gear 4, 6, and, according to the deviation of the actual distance value from the target distance value of the second distance sensor 17 ($\Delta b = b_{actual} - b_{target}$), control signals are generated for the lifting device(s) 5A, 7A which is/are functionally assigned to the right—in the working direction—front and/or rear running gear 5, 7. The control signals are received by the lifting devices 4A, 5A, 6A, 7A, and the lifting devices are moved in such a manner that the difference between the actual values and the target values is minimal.

The lifting devices 4A, 6A which are functionally assigned to the left—in the working direction A—front and/or the rear running gear 4, 6 are retracted if the first distance value $a_{actual}$ determined by the first distance measuring device 16 is greater than the prespecified distance value $a_{target}$, and the lifting devices 4A, 6A which are functionally assigned to the left—in the working direction A—front and/or rear running gear 4, 6 are extended if the first distance value $a_{actual}$ determined by the first distance measuring device 16 is less than the prespecified distance value $a_{target}$. In an analogous manner, the lifting devices 5A, 7A which are functionally assigned to the right—in the working direction A—front and/or the rear running gear 5, 7 are extended if the second distance value $b_{actual}$ determined by the second distance measuring device 17 is greater than the prespecified distance value $b_{target}$, and the lifting devices 5A, 7A which are functionally assigned to the right—in the working direction A—front and/or rear running gear 5, 7 are retracted if the second distance value $b_{actual}$ determined by the second distance measuring device 17 is less than the prespecified distance value $b_{target}$. The front and/or rear lifting devices 4A, 5A, 6A, 7A can be retracted and/or extended, respectively, by the same distance if the distance sensors are positioned at the height of the longitudinal axis 18 of the milling drum 9 arranged in the centre between the front and rear running gear mechanisms 4, 5, 6, 7.

With the adjustment described above, the desired milling depth is maintained over the width of the driving surface section being machined. Since the driving surface 20 is wider than the milling track—in the present embodiment, about twice as wide as the milling track—the track section 20B on the inner side of the road must also still be machined. To machine this section, the levelling device 15 provides a different levelling mode. This levelling mode corresponds to the known levelling, in which a distance measurement is carried out on the end faces of the milling drum 10 on both sides of the road milling machine. Consequently, the first distance measuring device 16 can be utilized, the same being designed in such a manner that its reference point R1 lies on the left side of the milling drum 10 in the working direction A. The levelling device 15 again generates the control signals for the lifting devices 4A, 6A of the left front and/or rear running gear 4, 6. However, the levelling device 15 in the present embodiment cannot make use of the second distance measuring device 17. Therefore, this distance measuring device 17 can be deactivated or need not be present (installed).

The control signals for the left and right, front and/or rear lifting devices 4, 5, 6, 7 are then generated by a levelling device 15, which will be described below. Since the levelling mode for the inside of the driving surface again provides for two distance measuring devices 16, 17, these distance measuring devices are again referred to as the first and/or the second distance measuring devices 16, 17. The levelling device 15 for the inner side 20B of the driving surface can be provided as the above-described levelling device for the outer side 20A of the driving surface if the distance sensor 17A of the second distance measuring device 17 is arranged on the right side of the machine frame 3 in the working direction A at a prespecified distance c from the distance sensor 16A of the first distance measuring device 16.

The distance sensors 16A, 17A can be designed as interchangeable units that can be attached to suitable brackets, such that the road milling machine can be equipped with suitable distance sensors for each of the levelling modes. However, it is also possible to even provide three distance measuring devices, or at least three distance sensors, on the road milling machine 1, of which only two distance measuring devices or distance sensors are activated for each given levelling mode.

Figure 4:
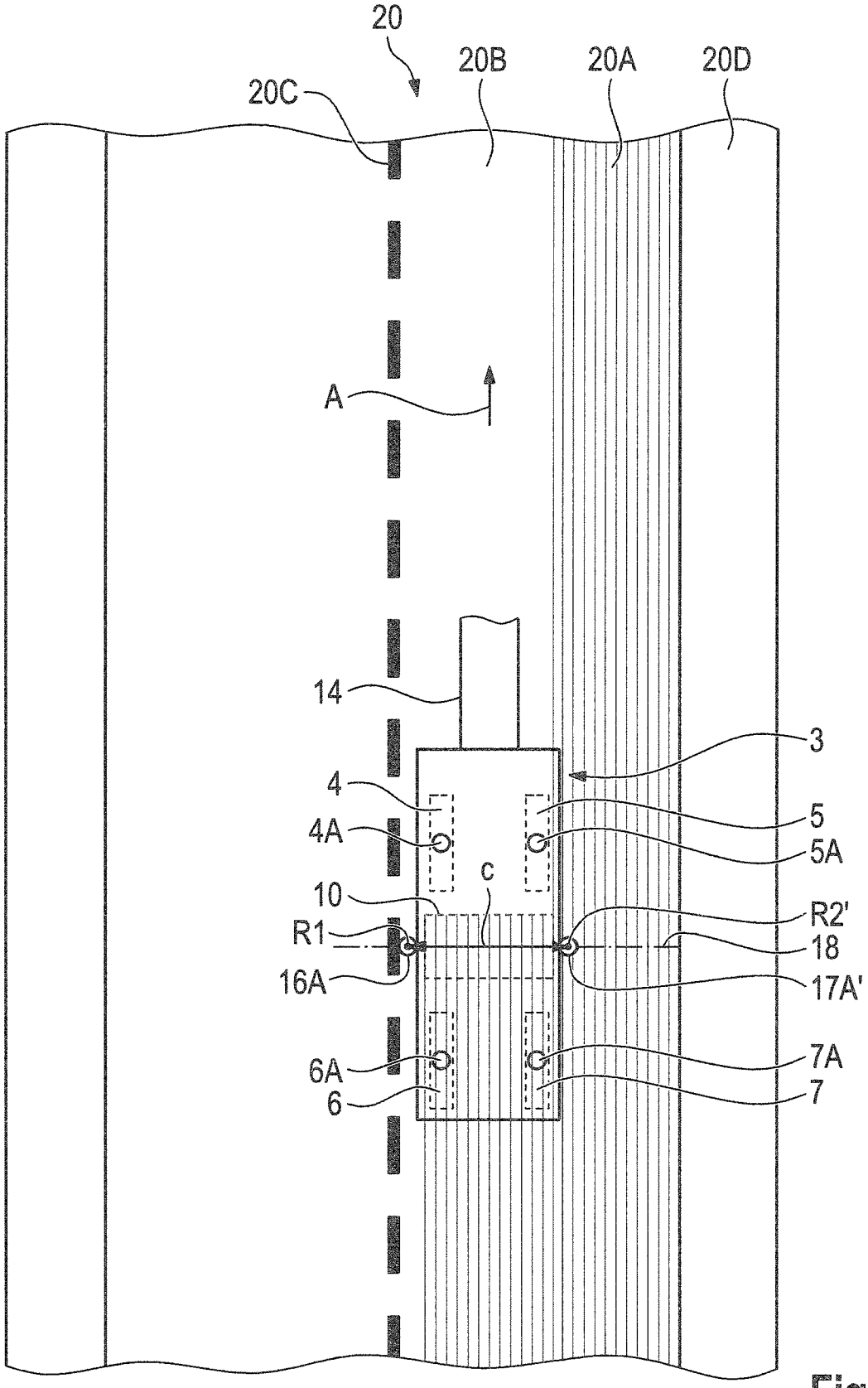
FIG. 4 shows a plan view of a driving surface that is being machined by the road milling machine, in which the road milling machine is machining a track section on the inside of the driving surface.

In the present embodiment, the distance measurement is performed on the right side of the machine with an optical distance sensor 17A' (FIGS. 4 and 5). The distance measurement on the right side of the machine can also be done with the right edge protector and a draw-wire sensor, which is already present on the left and right sides in the known road milling machines.

The control and computation unit 21 is configured for the levelling mode in the left track section on the inner side 20B of the driving surface in such a manner that the lifting devices 4A, 6A of the left front and/or rear running gear 4, 6 are retracted if the first distance value determined by the first distance measuring device 16 is greater than the prespecified distance value, and the lifting devices 4A, 6A of the left front and/or rear running gear 4, 6 are extended if the first distance value determined by the first distance measuring device 16 is less than the prespecified distance value. In an analogous manner, the lifting devices 5A, 7A of the rights front and/or rear running gear 5, 7 are retracted if the second distance value determined by the second distance measuring device 17' is greater than the prespecified distance value, and the lifting devices 5A, 7A of the right front and/or rear running gear 5, 7 are extended if the second distance value determined by the second distance measuring device 17' is less than the prespecified distance value. With this adjustment, the inner side 20A of the driving surface can be machined.

What is claimed is:

1. A road milling machine, comprising:

a machine frame on which a milling drum is arranged;

at least one running gear on a left side of the road milling machine in the working direction and at least one running gear on a right side of the road milling machine in the working direction;

lifting devices respectively corresponding to each of said running gears and upon which the machine frame is supported, wherein one or more of a height and an inclination of the machine frame is adjustable with respect to a driving surface by actuating of the lifting devices;

a first distance measuring device configured to measure a first distance between at least one associated reference point and the driving surface;

a second distance measuring device configured to measure a second distance between at least one associated reference point and the driving surface;

a controller configured to compare a first distance value corresponding to the first measured distance to a first prespecified distance value, to compare a second distance value corresponding to the second measured distance to a second prespecified distance value, and to generate control signals for one or more of the lifting devices according to respective deviations therefrom;

wherein in a first levelling mode for a track section on an outer side of the driving surface:

the respective reference points of the first and second distance measuring devices are each located on a first side of the milling drum closest to a centre of the driving surface, wherein the reference point of the second distance measuring device lies at a lateral distance extending from the reference point of the first distance measuring device and away from the milling drum;

the controller is configured, according to a deviation of the first distance value from the prespecified distance value, to generate control signals for the at least one lifting device corresponding to the first side of the milling drum, and the controller is configured, according to a deviation of the second distance value from the prespecified distance value, to generate control signals for the at least one lifting device corresponding to an opposing second side of the milling drum.

2. The road milling machine of claim 1, wherein in a second levelling mode for a track section on an inner side of the driving surface:

the first distance measuring device is configured such that its reference point lies on the left side of the milling drum in the working direction, the second distance measuring device is configured such that its reference point lies on the right side of the milling drum in the working direction, and the reference point of the second distance measuring device lies at a lateral distance from the reference point of the first distance measuring device on the right side of the reference point of the first distance measuring device.

3. The road milling machine of claim 2, wherein the controller, for the second levelling mode, is configured such that the at least one lifting device corresponding to the at least one running gear on the left side in the working direction is retracted if the first distance value is greater than the prespecified distance value, the at least one lifting device corresponding to the at least one running gear on the left side in the working direction is extended if the first distance value is less than the prespecified distance value, the at least one lifting device corresponding to the at least one running gear on the right side in the working direction is retracted if the second distance value is greater than the prespecified distance value, and the at least one lifting device corresponding to the at least one running gear on the right side in the working direction is extended if the second distance value is less than the prespecified distance value.

4. The road milling machine of claim 1, wherein:

the first and second distance measuring devices are configured such that their reference points lie on the left side of the milling drum in the working direction, the reference point of the second distance measuring device lies at a lateral distance from the reference point of the first distance measuring device on the left side of the reference point of the first distance measuring device, and the controller, for the first levelling mode, is configured according to the deviation of the first distance value from the prespecified distance value, to generate control signals for the at least one lifting device corresponding to the at least one running gear on the left side in the working direction, and according to the deviation of the second distance value from the prespecified distance value, to generate control signals for the at least one lifting device corresponding to the at least one running gear on the right side in the working direction.

5. The road milling machine of claim 4, wherein the controller is configured, for the first levelling mode, such that the at least one lifting device corresponding to the at least one running gear on the left side in the working direction is retracted if the first distance value is greater than the prespecified distance value, the at least one lifting device corresponding to the at least one running gear on the left side in the working direction is extended if the first distance value is less than the prespecified distance value, the at least one lifting device corresponding to the at least one running gear on the right side in the working direction is extended if the second distance value is greater than the prespecified distance value, and the at least one lifting device corresponding to the at least one running gear on the right side in the working direction is retracted if the second distance value is less than the prespecified distance value.

6. The road milling machine of claim 1, wherein:

the first and second distance measuring devices are configured such that their reference points lie on the right side of the milling drum in the working direction, the reference point of the second distance measuring device lies at a lateral distance from the reference point of the first distance measuring device on the right side of the reference point of the first distance measuring device, and the controller, for the first levelling mode, is configured according to the deviation of the first distance value from the prespecified distance value, to generate control signals for the at least one lifting device corresponding to the at least one running gear on the right side in the working direction, and according to the deviation of the second distance value from the prespecified distance value, to generate control signals for the at least one lifting device corresponding to the at least one running gear on the left side in the working direction.

7. The road milling machine of claim 6, wherein the controller, for the first levelling mode, is configured such that the at least one lifting device corresponding to the at least one running gear on the right side in the working direction is retracted if the first distance value is greater than the prespecified distance value, the at least one lifting device corresponding to the at least one running gear on the right side in the working direction is extended if the first distance value is less than the prespecified distance value, the at least one lifting device corresponding to the at least one running gear on the left side in the working direction is extended if the second distance value is greater than the prespecified distance value, and the at least one lifting device corresponding to the at least one running gear on the left side in the working direction is retracted if the second distance value is less than the prespecified distance value.

8. The road milling machine of claim 1, wherein the controller is configured to retract or extend the respective lifting devices such that the deviation of the first distance value or the second distance value from the prespecified distance value is minimized.

9. The road milling machine of claim 1, wherein the lateral distance of the reference point of the second distance measuring device from the reference point of the first distance measuring device in the first levelling mode corresponds to the lateral distance of the reference point of the second distance measuring device from the reference point of the first distance measuring device in the second levelling mode.

10. The road milling machine of claim 1, wherein one or more of the first and second distance measuring device comprises at least one distance sensor which is a tactile distance sensor or a contactless distance sensor.

11. The road milling machine of claim 1, wherein:

one or more of the first and second distance measuring device comprises a row of distance sensors arranged with an offset in the longitudinal direction of the road milling machine, and one or more of the first and second distance measuring device is configured to determine the respective distance value from the distances measured by the distance sensors.

12. A method for controlling a road milling machine comprising a machine frame on which a milling drum is arranged, at least one running gear on a left side of the road milling machine in the working direction, at least one running gear on a right side of the road milling machine in the working direction, and lifting devices respectively corresponding to each of said running gears and upon which the machine frame is supported, the method comprising:

measuring a first distance between at least one first reference point and a driving surface;

measuring a second distance between at least one second reference point and the driving surface; and in a first levelling mode for a track section on an outer side of the driving surface, wherein the first and second reference points are each located on a first side of the milling drum closest to a centre of the driving surface, and the second reference point lies at a lateral distance extending from the first reference point and away from the milling drum:

comparing a first distance value corresponding to the first measured distance to a first prespecified distance value, and actuating the at least one lifting device corresponding to the first side of the milling drum according to a deviation therefrom; and comparing a second distance value corresponding to the second measured distance to a second prespecified distance value, and actuating the at least one lifting device corresponding to a second and opposing side of the milling drum according to a deviation therefrom.

13. The method of claim 12, wherein the lifting devices are retracted and extended to minimize the deviation of the first distance value determined by the first distance measurement or the second distance value determined by the second distance measurement from the prespecified distance value.

14. The method of claim 12, wherein the lateral distance of the second reference point from the first reference point in the first levelling mode corresponds to the lateral distance of the second reference point from the first reference point in the second levelling mode.

15. The method of claim 12, wherein the distance measurement is a tactile or contactless distance measurement.

16. The method of claim 12, wherein the distance from the driving surface is measured at a series of reference points offset in the longitudinal direction of the road milling machine.

17. The method of claim 12, wherein:

the first and second reference points lie on the left side of the milling drum in the working direction, and the second reference point lies at a lateral distance from and on the left side of the first reference point, according to the deviation of the first distance value from the prespecified distance value, the at least one lifting device corresponding to the at least one running gear on the left in the working direction is actuated, and according to the deviation of the second distance value from the prespecified distance value, the at least one lifting device corresponding to the at least one running gear on the right in the working direction is actuated.

18. The method of claim 17, wherein during the movement of the construction machine in a track section on the outer side of the driving surface:

the at least one lifting device corresponding to the at least one running gear on the left side in the working direction is retracted if the first distance value is greater than the prespecified distance value, the at least one lifting device corresponding to the at least one running gear on the left side in the working direction is extended if the first distance value is less than the prespecified distance value, the at least one lifting device corresponding to the at least one running gear on the right side in the working direction is extended if the second distance value is greater than the prespecified distance value, and the at least one lifting device corresponding to the at least one running gear on the right side in the working direction is retracted if the second distance value is less than the prespecified distance value.

19. The method of claim 12, wherein:

the first and second reference points lie in the working direction on the right side of the milling drum, and the second reference point lies at a lateral distance from the first reference point on the right side of the first reference point, according to the deviation of the first distance value from the prespecified distance value, the at least one lifting device corresponding to the at least one running gear on the right side in the working direction is actuated, and according to the deviation of the second distance value from the prespecified distance value, the at least one lifting device corresponding to the at least one running gear on the left side in the working direction is actuated.

20. The method of claim 19, wherein:

the at least one lifting device corresponding to the at least one running gear on the right side in the working direction is retracted if the first distance value is greater than the prespecified distance value, the at least one lifting device corresponding to the at least one running gear on the right side in the working direction is extended if the first distance value is less than the prespecified distance value, the at least one lifting device corresponding to the at least one running gear on the left side in the working direction is extended if the second distance value is greater than the prespecified distance value, and the at least one lifting device corresponding to the at least one running gear on the left side in the working direction is retracted if the second distance value is less than the prespecified distance value.

21. The method of claim 12, wherein in a second levelling mode for a track section on an inner side of the driving surface:

the first reference point lies on the left side of the milling drum in the working direction, the second reference point lies on the right side of the milling drum in the working direction and at a prespecified lateral distance to the right of the first reference point.

22. The method of claim 21, wherein during movement of the construction machine in a track section on the inner side of the driving surface:

the at least one lifting device corresponding to the at least one running gear on the left side in the working direction is retracted if the first distance value is greater than the prespecified distance value, the at least one lifting device corresponding to the at least one running gear on the left side in the working direction is extended if the first distance value is less than the prespecified distance value, the at least one lifting device corresponding to the at least one running gear on the right side in the working direction is retracted if the second distance value is greater than the prespecified distance value, and the at least one lifting device corresponding to the at least one running gear on the right side in the working direction is extended if the second distance value is less than the prespecified distance value.

* * * * *